US005115856A

United States Patent [19]

Downing et al.

[11] Patent Number: 5,115,856

[45] Date of Patent: May 26, 1992

[54] CORE BOX WITH LARGE DIAMETER VENTS AND PLUGS

[75] Inventors: Robert E. Downing, Toledo, Ohio; Bobby L. Wilson, Poplar Bluff, Mo.

[73] Assignee: Doehler-Jarvis Limited Partnership, Toledo, Ohio

[21] Appl. No.: 753,957

[22] Filed: Sep. 3, 1991

[51] Int. Cl.[5] ..... B22C 7/06

[52] U.S. Cl. ..... 164/234; 164/410

[58] Field of Search ..... 164/234, 410; 249/141

[56] References Cited

U.S. PATENT DOCUMENTS

| | | | |
|---|---|---|---|
| 783,576 | 2/1905 | Haggenjos . | |
| 1,007,458 | 10/1911 | Lamont . | |
| 1,010,392 | 11/1911 | Lamont . | |
| 2,238,506 | 4/1941 | Rienacker . | |
| 2,789,326 | 4/1957 | Krauss . | |
| 3,160,928 | 12/1964 | Smillie | 164/410 |
| 3,188,701 | 6/1965 | McIntyre . | |
| 3,214,803 | 11/1965 | Arnt | 164/234 X |
| 3,572,421 | 3/1971 | Mezey et al. | 164/237 |
| 3,602,293 | 8/1971 | Barrett | 164/410 |
| 3,631,918 | 1/1972 | Barrett | 164/410 |
| 4,638,848 | 1/1987 | Yamasaki et al. | 164/305 |

*Primary Examiner*—J. Reed Batten, Jr.
*Attorney, Agent, or Firm*—Hugh Adam Kirk

[57] ABSTRACT

The core box has a drag and a cope forming a mold cavity for forming a sand base core. This sand is injected into the cope and the air in the cavity is vented through vents remote or spaced away from where the sand is inserted. These vents are usually in the drag, but may also be in the cope. In each vent adjacent the cavity is a cylindrical cup-shaped plug having slotted perforations in its bottom narrower than the diameter of the sand grains. The diameter of this perforated vent plug is at least 50% greater and preferably at least twice the width of the cavity, slot, or groove at the vent whereby air can be vented along the cavity. Furthermore, the plug having the perforations may be contoured to the groove or that portion of the cavity in which the vent is located so that air can also be vented from the sides of the cavity or groove. These plugs are held in place by sleeves that contact the rim of the cup and extend to the outside of the mold where the sleeves are held in place by overlapping washers or heads of bolts screwed into the mold.

13 Claims, 5 Drawing Sheets

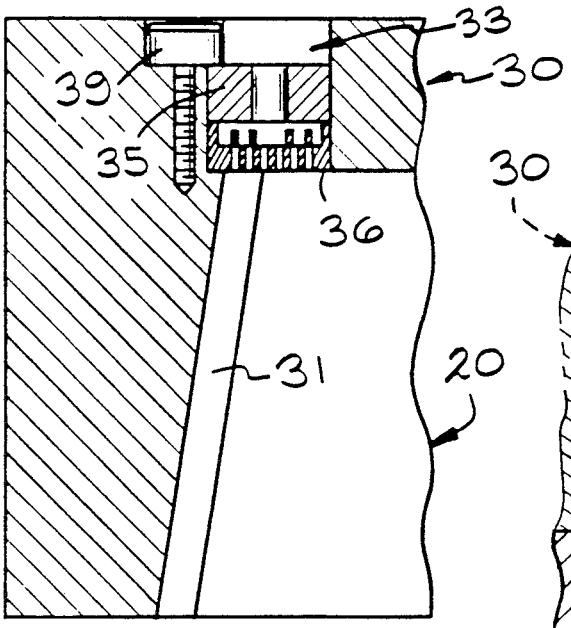
FIG. 7
FIG. 8
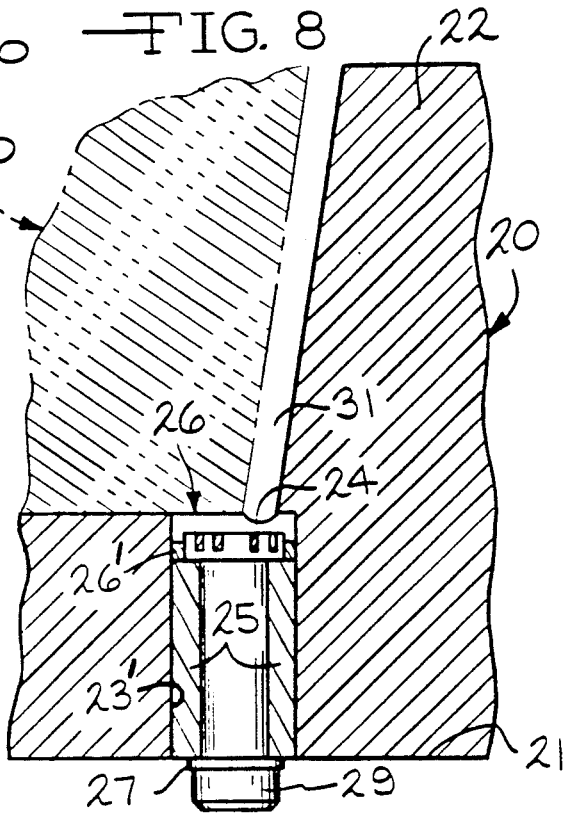
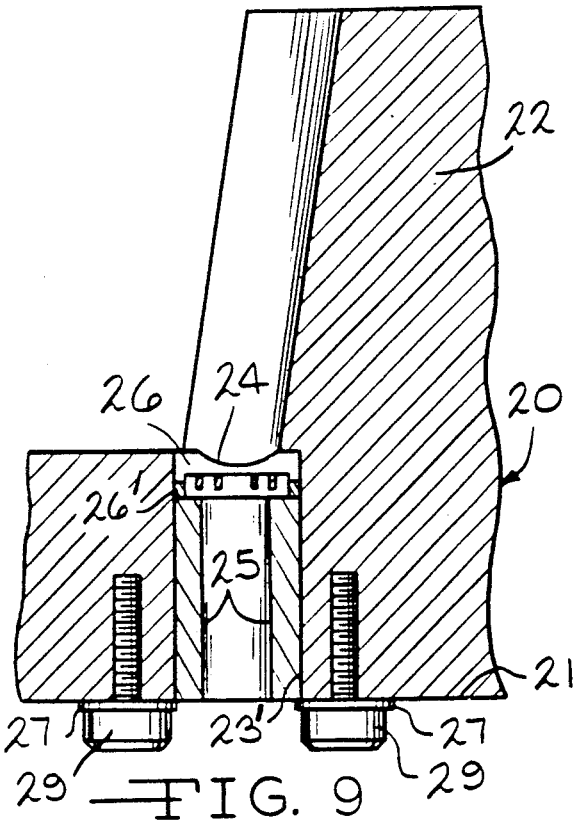
FIG. 9

CORE BOX WITH LARGE DIAMETER VENTS AND PLUGS

BACKGROUND OF THE INVENTION

Previously cup-shaped plugs with perforated or slotted bottoms have been used in the vents adjacent the cavity in a drag of a core box; however, each plug had a diameter never greater and often less than the width of the slot or groove in the cavity, not to mention being contoured to the cavity. Therefore, in order to obtain adequate venting for fast production operations, the number of vents and bolt holes which could be formed in the drag became insufficient as well as weakening the drag, thus limiting the core box operation.

Generally speaking, the core box involved produces sand cores for castings. This core box has a cope (top) and drag (bottom) which form a mold cavity for forming the sand core. Usually the sand is injected into the cope and most of the air in the mold cavity is forced out through vents in the cavity spaced away and preferably remote from the injection of the sand. The vents thus are usually in the drag, but may also be in the cope, including the sides of the cavity for pull jacks to form undercuts. In order to prevent the sand from passing through the vents, each vent adjacent the cavity is provided with a plug having a cylindrical cup-shape whose bottom is filled with perforations having openings less than the minimum diameter of the sand grains making up the core, so that sand will not escape or plug the perforations.

The important feature of this invention is forming these plugs and their vents with diameters at least 50% larger, and preferably twice or more times the width of the slots or grooves in the cavity where the vents are to be located. Furthermore, the perforated bottoms of the cup-shaped plugs also may be and preferably are contoured to fit and continue the contour of the cavity, slot or groove where they are located. Although this structure does not take advantage of all of the apertures in the enlarged cup-shaped plug, it more than compensates for the perforations which do not open into the cavity by providing perforations along the length of the slot and/or groove, as well as also up any contoured sides thereof. Since the diameter of the vent and plug are greater than the width of the cavity slot where the larger vents are located, it is essential that the end of the plug conforms with the portion of the cavity in which it is located. The perforations in the plug may comprise holes or slots which may be parallel or formed into different configurations.

The plugs are held in place by sleeves in the vent apertures, which sleeves contact the peripheral or cylindrical flange forming the rim of the cup of the plug. These sleeves also are of sufficient length to hold the plugs in proper alignment with the cavity. The other and outer end of these sleeves may be held in place by the head or a washer on one or more adjacent bolts, preferably two, which heads or washers overlap the outer end of the sleeves. Furthermore, because of the space necessary for these bolts and washers to hold the sleeves in place, there can only be a certain amount of vents or holes placed in the bottom or sides of the drag or mold without weakening it, i.e. by the plurality of vent holes and bolt holes therein. Thus fewer and larger and more spaced apertures for vents are employed, not only to maintain sufficient strength in the mold, but also increasing the amount of air that can be vented at one time. Since the diameter of the vents and their cups are greater than the width of the slot, groove or end of the cavity, the space taken up by one large vent and/or its contoured plug allows much more air to be vented at a time, than two or even three or more small prior art plugs in smaller vent holes.

OBJECTS AND ADVANTAGES

It is an object of this invention to produce efficient, effective, economic, and simple vent plugs for core boxes for making sand cores for castings.

Another object is to produce a strong core box with large diameter vents and plugs for increasing the speed of forming the cores by enabling more air to be vented from the cavity in and at a given time.

A further object is to produce a core box in which the vent plugs are easier to install and exchange because of their increase in size and reduction in number.

Still another object is to produce a vent plug for a core box, which plug is contoured to the end of the cavity in which it is located.

A still further object is to produce vents for a core box which allow for less cleaning, and also provide vents that are easier to clean and maintain.

BRIEF DESCRIPTION OF THE VIEWS

The above mentioned and other objects, features and advantages, and a manner of attaining them, are described more specifically below by reference to an embodiment of this invention shown in the accompanying drawings, wherein:

FIG. 7 is an enlarged vertical sectional view through a vent and plug taken along line 7—7 of FIG. 4;

FIG. 8 is an enlarged sectional view taken along line 8—8 of FIG. 5 through a vent and contoured plug in the cope;

FIG. 9 is an enlarged vertical sectional view taken along line 9—9 of FIG. 5 through a vent and contoured plug in the drag.

DETAILED DESCRIPTION OF PREFERRED EMBODIMENT

A. Prior Art

Figure 1:
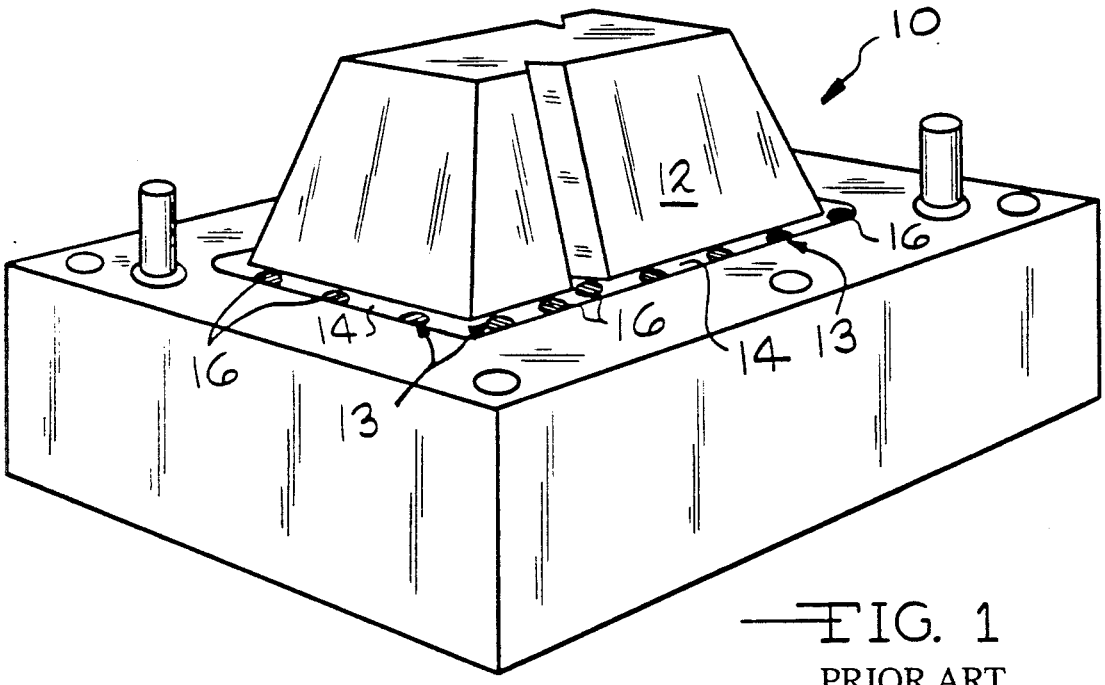
FIG. 1 PRIOR ART
FIG. 1 is a perspective view of the upper end of a drag mold for a prior art core box for forming a core.
Figure 2:
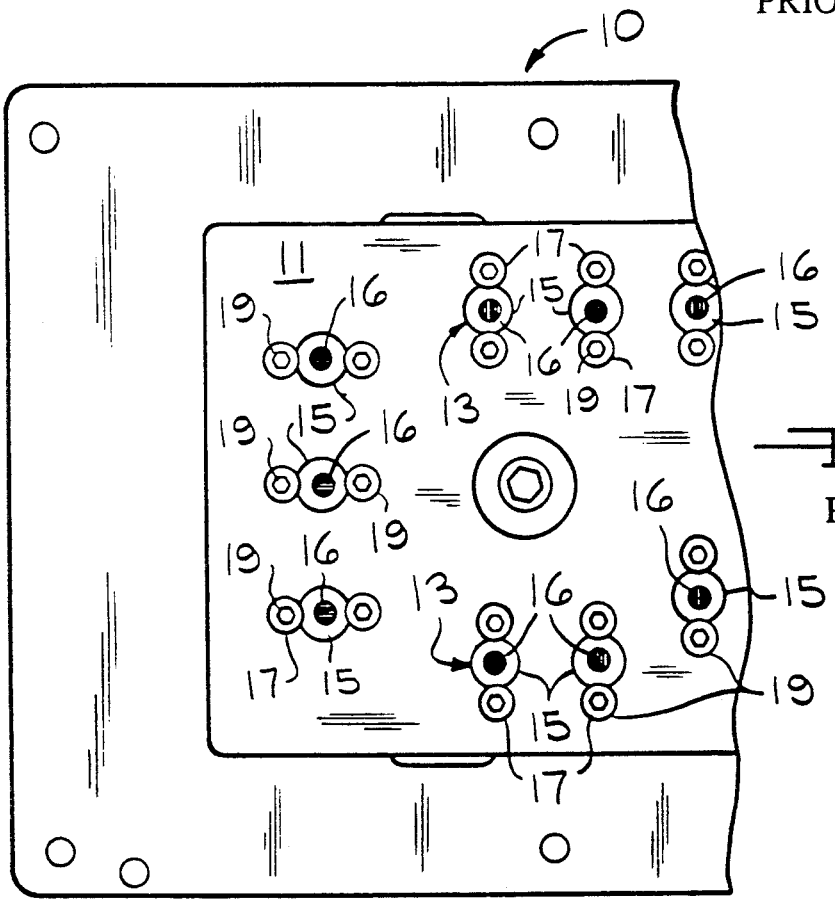
FIG. 2 PRIOR ART
FIG. 2 is an enlarged bottom view of the prior art drag mold shown in FIG. 1 with a part broken away, showing a plurality of vent and bolt holes corresponding to those shown in the groove around the base of the drag shown in FIG. 1.

Referring first to FIGS. 1 and 2 of the prior art, there is shown a drag mold 10 of a core box for forming a difficult-to-vent core showing a notched boss 12 and a groove 14 around its base, in the bottom of which groove 14 are a plurality of small diameter vent plugs 16 having parallel slots therein. These slotted vent plugs 16 are shown from the underside of the mold in FIG. 2 in the recessed portion 11 of the drag. Each of the vents 13 is shown to contain a hollow cylindrical sleeve 15, which sleeve 15 is held in place by a pair of washers 17 on bolts 19 screwed into the drag.

It can easily be seen that the number of vents 13 with plugs 16 that can be placed around in the groove 14 is limited by a space required for holding the sleeves 13 as shown in FIG. 2, plus the fact more holes weakens the drag.

B. The Invention

Figure 3:
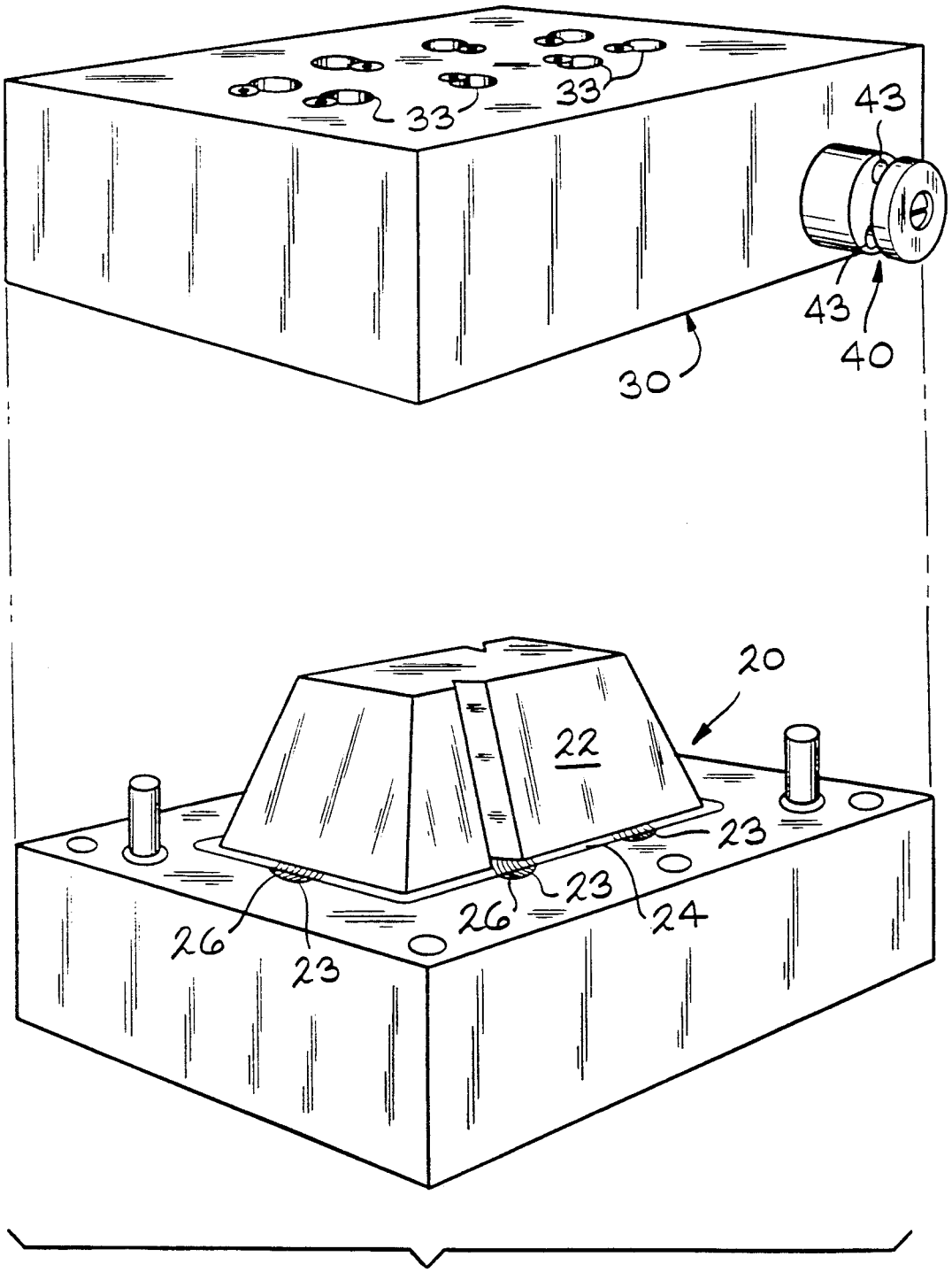
FIG. 3 is a perspective view of an open cope and drag of a mold, similar to the drag shown in FIG. 1, and with a pull jack on the cope, employing the improved large and/or contoured vent plugs according to this invention.
Figure 4:
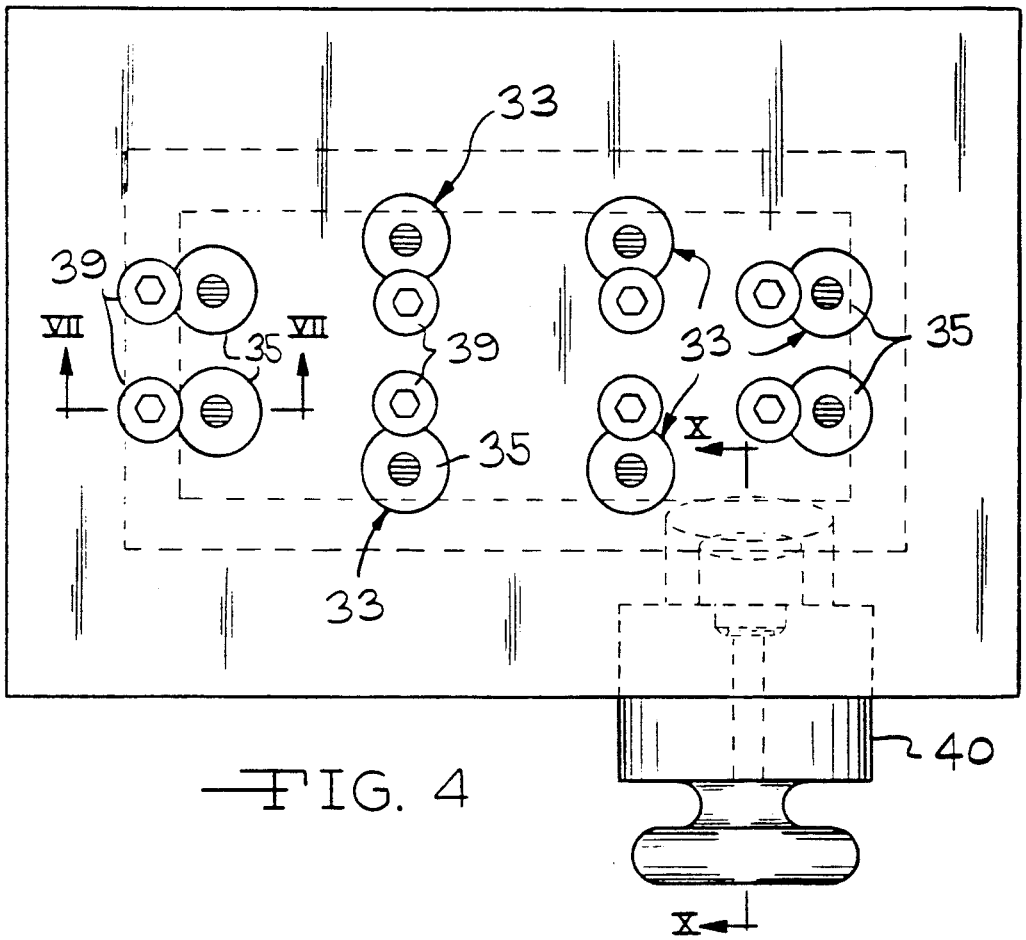
FIG. 4 is a plan view of the cope shown in FIG. 3.
Figure 5:
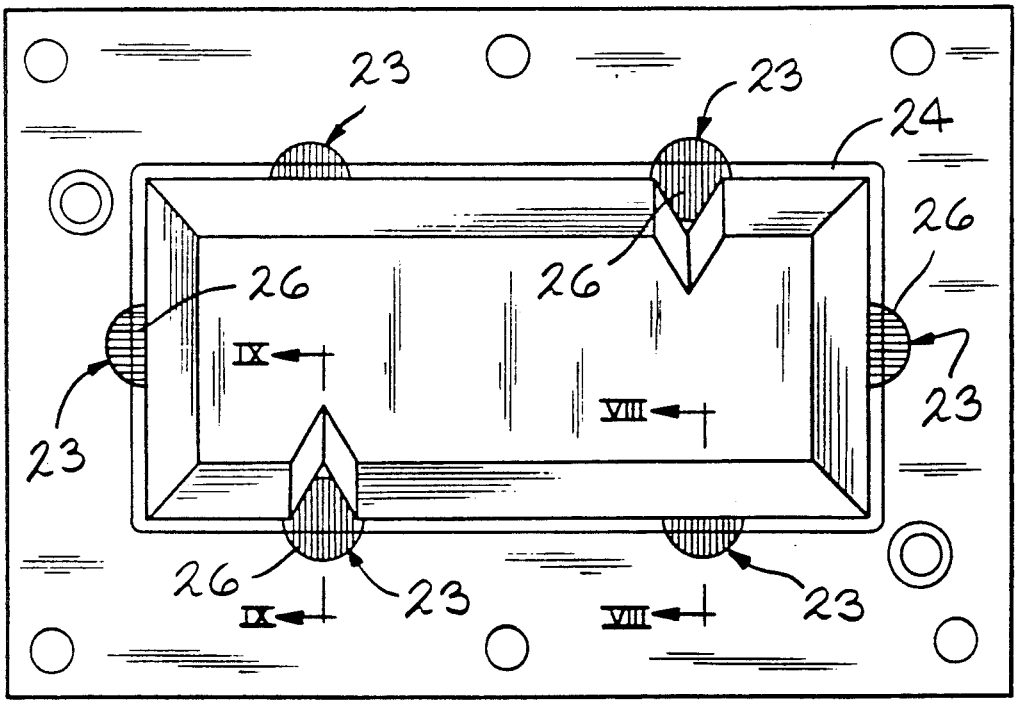
FIG. 5 is a plan view of the drag shown in FIG. 3.
Figure 6:
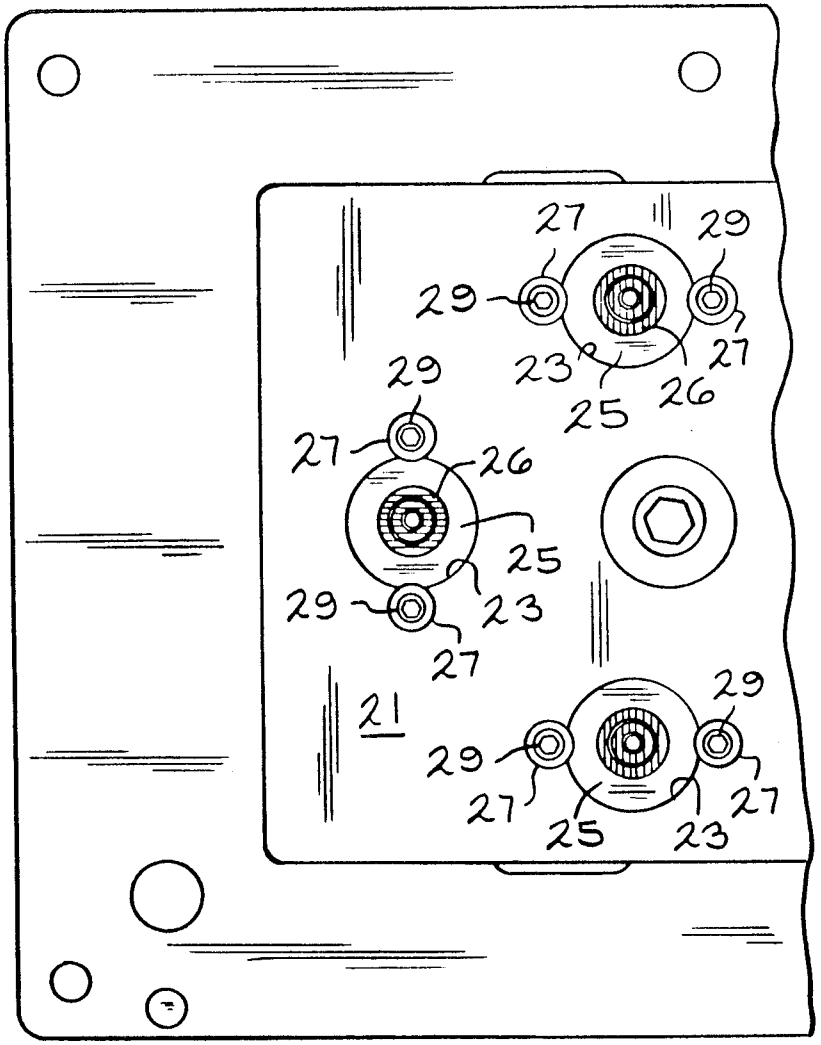
FIG. 6 is an enlarged bottom view of the drag mold in FIG. 3 with a part broken away, similar to that of the drag shown in FIG. 2, showing the reduced number of vents and bolt holes in the drag mold.

Referring now to FIGS. 3, 4, and 6 in comparison with FIGS. 1 and 2, there is shown the drag mold or die 20 of the core box similar to that shown in FIG. 1 for making an identical shaped core. Raised above the drag mold is the cope mold or die 30. This drag 20 similarly comprises a notched boss 22 which has around its lower end a groove 24, similar to groove 14 shown in FIG. 1. However, instead of having many vents with their perforated plugs 16 in the trough 24, there are shown fewer and larger perforated vent plugs 23 which permit more air to be vented in a given period of time.

Although it has been stated that only part of the top perforated surface of the larger vent plugs 23 is in the cavity, there is shown in dotted lines in FIG. 8 a broken-away part of the cope die 30 in its position when the mold is closed to show the size of the cavity 31 which is filled with the sand that makes the core. This cavity 31 has at its lower end the groove 24 which is contoured into the perforated or slotted top of the plug 26. The perforated part of the plug extends herein along the base of the trough or groove 24 more than twice the width in the cavity 31 or groove 24 and is contoured to the shape of the cavity or groove 24. Thus the apertures or slots in the plugs 26 extend not only along the groove and across the bottom of the groove but also up the sides thereof, greatly increasing the area which has access to venting the air from the cavity 31.

In FIG. 6, 8 and 9, there is shown the countersunk portion 21 in the bottom of the drag 20 and the larger vent holes 23 at the inner end of which holes 23 are provided the contoured plugs 26. Between the plugs 26 and the surface of the offset portion 21 are cylindrical sleeves 25 which hold plugs 26 in place against the peripheral flanges, cup rims, or ridges 26' of these plugs 26. These sleeves 25 in turn are held in place by washers 27 around the end of the heads of bolts 29, which washers 27 overlap the edge of the outer end of the sleeves 25 as shown more clearly in FIGS. 6, 8 and 9.

Referring now to the cope part 30 of the core box mold, it is shown herein to contain a plurality of top vents 33 and on one side thereof a pull jack 40 for forming undercuts in the core formed in the mold, which pull jack also contains vents 43.

As shown in FIG. 7, the vent 33 and its perforated plug 36 has a diameter over twice the width of the cavity 31 and may be held in place by a cylindrical sleeve 35 engaging the head of a countersunk bolt 39.

Figure 10:
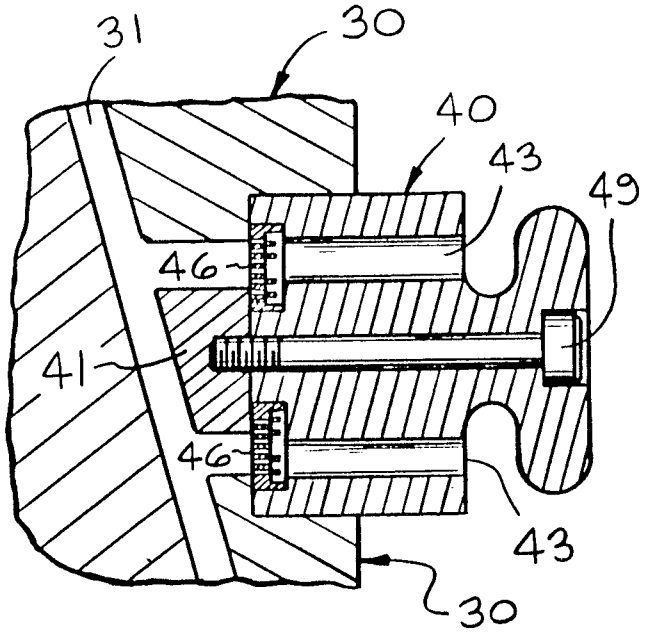
FIG. 10 is an enlarged vertical sectional view taken along line 10—10 of FIG. 4 through the pull jack and its vents in the cope.

Referring now more specifically to FIG. 10, the pull jack 40 contains an undercut-forming portion 41 in the cavity 31, which pull jack 40 herein is shown to have two vents 43 which have placed therein enlarged perforated cup-shaped plugs 46 which also have diameters greater than that of the cavity 31. These pull jack parts and plugs may be held in by means of a bolt 49.

The present invention shown in FIGS. 3 through 10 involved less than half the vent ducts in the drag mold, provides more venting area, less maintenance, and plugs which are easier to install, clean and change, than the prior art vents and plugs shown in FIGS. 1 and 2.

Although there is shown plugs having parallel longitudinal slits as pointed out above, other shaped slits, apertures or perforations and their configurations may be provided in the enlarged and/or contoured plugs 26, 36, and/or 46 without departing from the scope of this invention. Furthermore, the width of these slits, apertures or perforations is less than the size of a sand grain, namely varying between ten and eighteen thousandths of an inch.

Furthermore, although the specific drag mold shown for illustrating the larger vents with contoured vent plugs of this invention, other molds for cores which have narrow cavities for vents can employ the larger vents and contoured plugs according to this invention. Also the plugs may be other than cylindrical, if desired. Therefore, it is to be clearly understood that this description is made only by way of example and not as a limitation to the scope of this invention.

We claim:

1. A core box having a mold for forming a cavity having a plurality of air vents, said vents extending from said cavity through the mold, each said air vent containing a perforated bottom cup-shaped plug having a diameter at least 50% larger than the width of the cavity where said plug is located.

2. A core box according to claim 1 wherein the diameter of said plug is at least twice the width of said cavity.

3. A core box according to claim 1 wherein the perforated bottom of said plug is contoured to conform with the cavity when said plug is located.

4. A core box according to claim 1 including sleeves in said vents for holding said plugs in place.

5. A core box according to claim 4 including means for holding said sleeves in place.

6. A core box according to claim 5 wherein said holding means comprises bolts with washers that overlap the outer end of said sleeves.

7. A core box according to claim 1 wherein said perforated plugs have parallel slots.

8. A core box according to claim 1 wherein said cavity is for molding a sand core for castings.

9. A core box according to claim 8 wherein said perforations in said cup-shaped plugs are smaller in diameter than the diameter of the sand that forms said core.

10. A core box according to claim 1 wherein said mold comprises a drag and a cope for forming said cavity.

11. A core box according to claim 10 wherein said drag has a plurality of air vents from said cavity.

12. A core box according to claim 10 wherein said cope has a plurality of air vents from said cavity.

13. A core box having a mold for forming a cavity, said cavity having a plurality of air vents containing perforated bottom cylindrical shaped plugs, the improvement comprising:

a) each said plug having a diameter at least 50% larger than the width of said cavity where said cavity is located, and b) each said plug being contoured to said cavity where said cavity is located.

* * * * *

UNITED STATES PATENT AND TRADEMARK OFFICE

CERTIFICATE OF CORRECTION

PATENT NO. : 5,115,856

DATED : May 26, 1992

INVENTOR(S) : Robert E. DOWNING and Bobby L. WILSON

It is certified that error appears in the above-identified patent and that said Letters Patent is hereby corrected as shown below:

Column 3, line 46, change "23" to - - 23' - - (both occurrences)

Signed and Sealed this

Tenth Day of August, 1993

*Attest:*

Michael K. Kirk

MICHAEL K. KIRK

*Attesting Officer*

*Acting Commissioner of Patents and Trademarks*